US005921372A

United States Patent [19]

Millhiser et al.

[11] Patent Number: 5,921,372

[45] Date of Patent: Jul. 13, 1999

[54] MULTIPLE CHAMBERED CONTAINER COMPACTION ASSEMBLY WITH DIVERTER

[75] Inventors: John D. Millhiser, Aldie; Donald E. Dawson, Hamilton, both of Va.

[73] Assignee: Environmental Products Corporation, Chantilly, Va.

[21] Appl. No.: 08/850,924

[22] Filed: May 2, 1997

[51] Int. Cl.[6] ..... G07F 7/06

[52] U.S. Cl. ..... 194/209

[58] Field of Search ..... 194/208, 209, 194/212, 213, 346; 193/31 R, 31 A; 198/359, 360; 100/902

[56] References Cited

U.S. PATENT DOCUMENTS

| | | | |
|---|---|---|---|
| 3,894,697 | 7/1975 | Lawson et al. . | |
| 3,991,944 | 11/1976 | Baikoff . | |
| 4,018,392 | 4/1977 | Wagner . | |
| 4,669,673 | 6/1987 | Lodovico et al. . | |
| 4,678,126 | 7/1987 | Prentice et al. . | |
| 4,702,422 | 10/1987 | Chambers, Sr. et al. . | |
| 4,703,899 | 11/1987 | Lodovico . | |
| 4,717,085 | 1/1988 | Crane . | |
| 4,729,515 | 3/1988 | Wagner . | |
| 4,750,678 | 6/1988 | Lodovico et al. . | |
| 4,923,126 | 5/1990 | Lodovico et al. . | |
| 4,944,462 | 7/1990 | Raterman et al. . | |
| 4,981,270 | 1/1991 | Reber . | |
| 5,048,767 | 9/1991 | Mori | 241/236 |
| 5,062,576 | 11/1991 | Burda . | |
| 5,155,975 | 10/1992 | Knowler . | |
| 5,160,095 | 11/1992 | Pepper . | |
| 5,161,661 | 11/1992 | Hammond | 194/209 |
| 5,163,629 | 11/1992 | Raterman et al. . | |
| 5,178,336 | 1/1993 | Lodovico et al. . | |
| 5,465,822 | 11/1995 | DeWoolfson et al. | 194/209 |
| 5,496,212 | 3/1996 | Meyer-Weingartner et al. | 194/346 |
| 5,560,552 | 10/1996 | Powell et al. | 241/100 |

FOREIGN PATENT DOCUMENTS

| | | |
|---|---|---|
| 0 069 721 | 1/1983 | European Pat. Off. . |
| 0 174 148 | 3/1986 | European Pat. Off. . |
| 0182 749 A2 | 5/1986 | European Pat. Off. . |
| 0 486 872 | 5/1992 | European Pat. Off. . |
| 3705 623 A1 | 1/1988 | Germany . |
| 5-84450 | 4/1993 | Japan . |
| 2171028 | 8/1986 | United Kingdom . |
| WO 91/17690 | 11/1991 | WIPO . |

*Primary Examiner*—F. J. Bartuska
*Assistant Examiner*—Bryan J. Jaketic
*Attorney, Agent, or Firm*—Finnegan, Henderson, Farabow, Garrett & Dunner, L.L.P.

[57] ABSTRACT

A container compaction assembly includes a chamber. First and second parallel counter-rotating shafts are mounted in the chamber. A plurality of interleaved compacting wheels are mounted on the first and second shafts, respectively. A divider is mounted in the chamber perpendicular to the shafts, having first and second arcuate openings through which the respective shafts pass, the divider dividing the chamber into first and second chamber portions. A diverter is provided which, in response to a characteristic of the container sensed by a sensing device, diverts containers into one or the other of the chamber portions.

26 Claims, 6 Drawing Sheets

MULTIPLE CHAMBERED CONTAINER COMPACTION ASSEMBLY WITH DIVERTER

BACKGROUND OF THE INVENTION

1. Field of the Invention

The present invention relates to a container compaction device. More specifically, the invention relates to a multiple chambered container compaction device, e.g., a multiple-chambered container shredder, including a diverter. The invention is suitable for use in recycling machines such as reverse vending machines.

2. Description of the Related Art

Increased emphasis on environmental cleanup has led many jurisdictions to mandate recycling of beverage containers, because post-consumer beverage containers typically comprise a major portion of garbage dumps and landfills.

A device for recycling post consumer beverage containers is a reverse vending machine, or RVM. An RVM is similar in appearance to a conventional beverage vending machine, and is used to recycle bottles and cans. The RVM receives a used beverage container, compacts the container by either shredding or crushing it, stores the compacted container, and issues a refund in exchange for the container.

Traditional RVMs have drawbacks associated with the compaction of the containers. The profit of the RVM owner results from resale of the compacted container material to the beverage container manufacturers. The compacted container material is called "cullet." However, containers are made of several different materials, with different characteristics. For example, containers can be made of aluminum or plastic, the plastic can be either PET or PVC, and the plastic can be colored (e.g., green), clear, or opaque. However, the value of the cullet is directly related to how "pure" it is. In other words, a pound of pure clear PET cullet is much more valuable than a pound of clear PET cullet contaminated with green PET cullet, PVC cullet, or aluminum cullet. Furthermore, the container manufacturer may even refuse to accept contaminated (i.e., mixed) cullet. Consequently, contaminated cullet often is returned to garbage dumps, completely losing the environmental and monetary benefits of recycling.

Efforts have been made to provide RVMs with segregated storage bins in an effort to prevent cross-contamination of cullet. Other efforts have been made to provide multiple RVMs for separate types of containers, or a single RVM with multiple compaction devices. These efforts have been partially successful. Problems still exist because the space available for multiple RVMs is limited, and because space in a single RVM cabinet available for container compaction devices is also limited. Consequently, the same compaction device in a single RVM is often used for aluminum, PVC, PET, and various colors of plastic containers. Bits of compacted plastic or aluminum tend to stick to various components of the compaction device, however, occasionally dropping off and cross contaminating cullet of a different material or color.

SUMMARY OF THE INVENTION

Accordingly, the present invention is directed to a compaction device, and to an RVM containing such a compaction device, that substantially avoids one or more of the problems caused by the limitations and disadvantages of the related art.

The present invention relates to a container compaction assembly. The assembly includes a chamber. First and second parallel counter-rotatable shafts are rotatably mounted in the chamber, each shaft having first and second distal ends. A first and second plurality of compacting wheels are positioned on the first and second shafts, respectively, the first plurality of compacting wheels on the first shaft being interleaved with the second plurality of compacting wheels on the second shaft. A divider is mounted in the chamber perpendicular to the first and second shafts and intermediate the first and second distal ends, the divider having first and second arcuate openings through which the first and second shafts project, the divider dividing the chamber into first and second chamber portions. A diverter is also provided for diverting containers into one or the other of the first and second chamber portions.

The present invention further relates to a reverse vending machine. The RVM includes a cabinet, an acceptance mechanism in the cabinet for receiving a container, a sensor for sensing a characteristic of the container, and a container compaction assembly in the cabinet. The compaction assembly comprises a chamber, first and second parallel counter-rotatable shafts rotatably mounted in the chamber, each shaft having first and second distal ends, a first and second plurality of compacting wheels positioned on the first and second shafts, respectively, the first plurality of compacting wheels on the first shaft being interleaved with the second plurality of compacting wheels on the second shaft, a divider mounted in the chamber perpendicular to the first and second shafts and intermediate the first and second distal ends, the divider having first and second arcuate openings through which the first and second shafts project, the divider dividing the chamber into first and second chamber portions, and a diverter for diverting containers into one or the other of the first and second chamber portions in accordance with the sensed characteristics. A device is also provided in the cabinet for issuing a refund in exchange for the container.

Additional features and advantages of the invention will be set forth in the description which follows, and in part will be apparent from the description, or may be learned by practice of the invention. The advantages of the invention will be attained by the apparatus particularly pointed out in the written description and claims, as well as the attached drawings.

BRIEF DESCRIPTION OF THE DRAWINGS

The accompanying drawings, which are included to provide a further understanding of the invention, are incorporated in and constitute part of this specification. Together with the description, the drawings serve to explain the principles of the invention. In the drawings.

DESCRIPTION OF THE PREFERRED EMBODIMENTS

Figure 1:
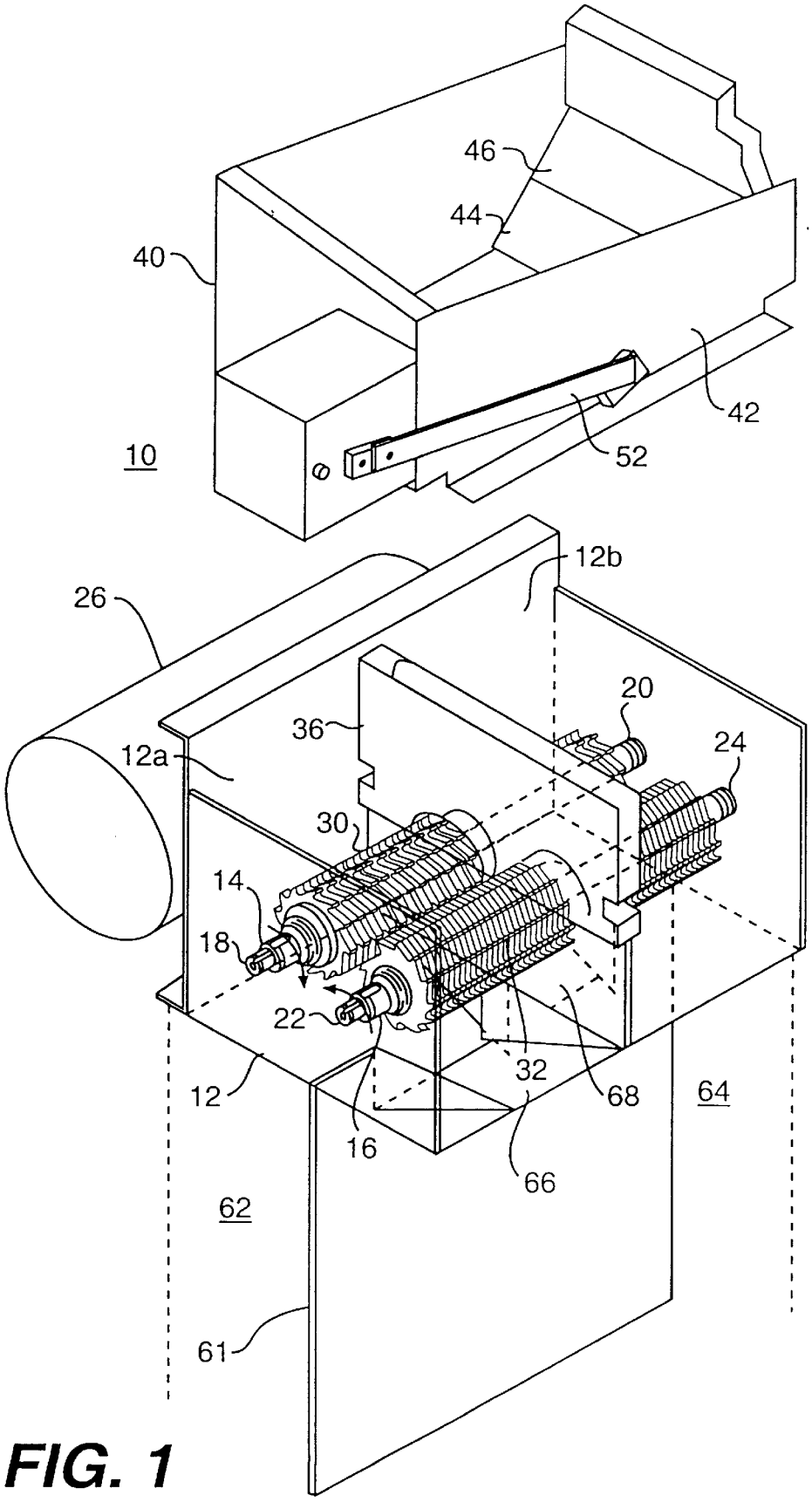
FIG. 1 is a perspective view of a multiple-chambered compaction device and diverter in accordance with the invention, with the counter-rotating shafts and compaction wheels shown spaced apart, and the diverter shown spaced apart from the compaction chamber, for ease of explanation.

Reference will now be made in detail to the present preferred embodiments, examples of which are illustrated in the accompanying drawings.

A container compaction assembly is designated generally by reference numeral 10.

In accordance with the invention, a container compaction assembly includes a chamber. As shown in FIG. 1, a chamber 12 is defined by a front wall, rear wall, and side walls. In the embodiment of FIG. 1, one of the side walls is not shown. The chamber 12 is open at top and bottom to allow containers to enter at the top and compacted cullet to exit at the bottom.

In accordance with the invention, first and second parallel counter-rotating shafts are rotatably mounted in the chamber, each shaft having first and second distal ends. As shown in FIG. 1, a first shaft 14 and a second shaft 16 are mounted in chamber 12, rotatable in opposite directions. Each shaft has first and second distal ends 18 and 20, 22 and 24, respectively. The shafts are driven by a drive unit 26, preferably a 3HP electric motor with gear reduction box. Drive unit 26 preferably is connected to distal end 20 of first shaft 14 by a chain linkage (not shown). On the opposite distal end 18, a set of gears (not shown) connects first shaft 14 to distal end 22 of second shaft 16. A sprocket and chain linkage also connects the shafts 14 and 16 to a set of rotatable flexible feeding paddles (not shown) located above the chamber 12. The feed paddles are well known in the compaction device art, and are fully described in U.S. Pat. No. 5,560,552, owned by applicants' assignee, the disclosure of which is specifically incorporated by reference herein. Accordingly, the feed paddles will not be further described.

Figure 2:
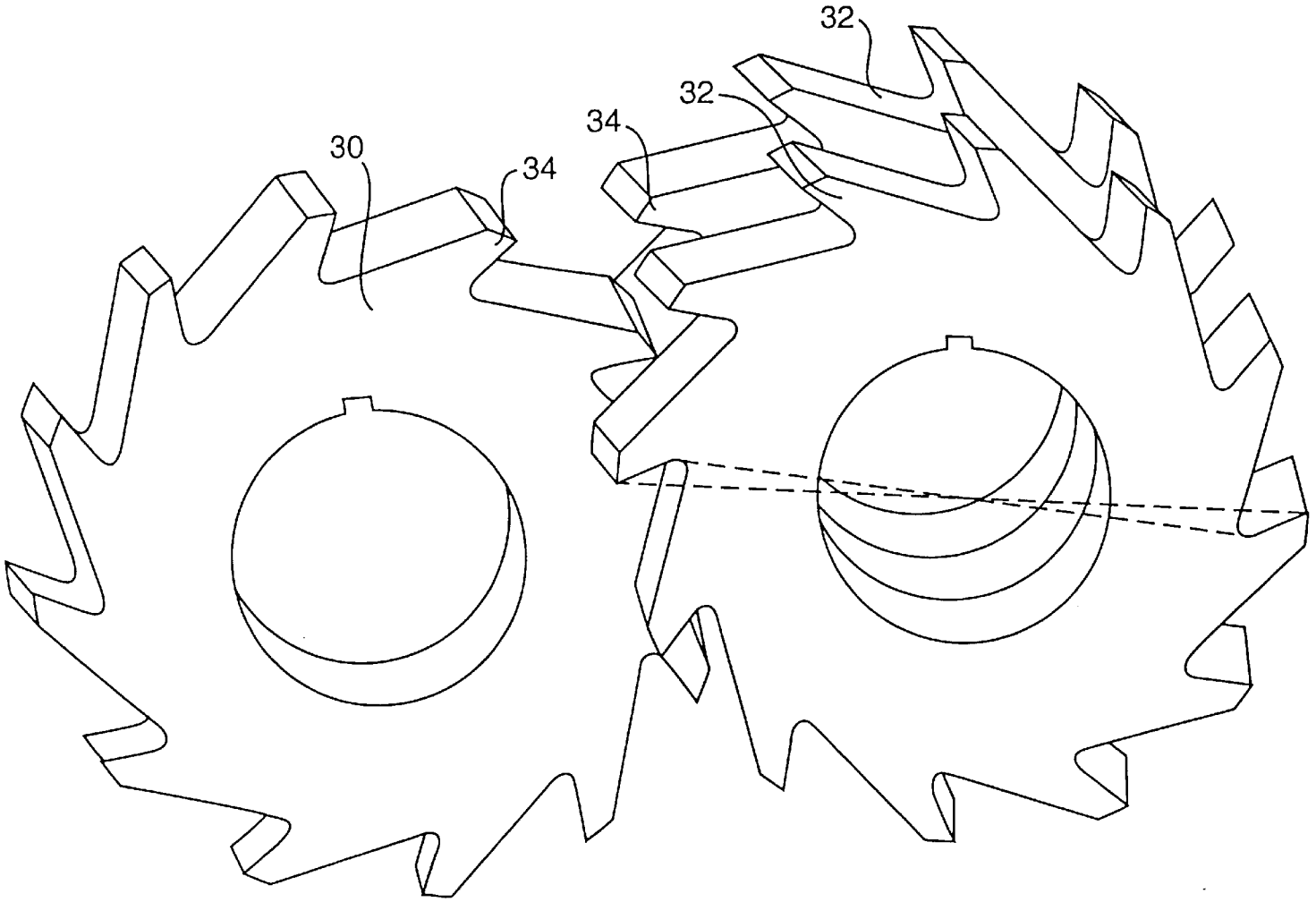
FIG. 2 is a perspective partial view of interleaved compacting wheels of a compaction device in accordance with the invention.

In accordance with the invention, a first and second plurality of compacting wheels are positioned on the first and second shafts, respectively, the first plurality of compacting wheels on the first shaft being interleaved with the second plurality of compacting wheels on the second shaft. Preferably, the compacting wheels comprise cutting wheels, used to shred aluminum and plastic containers into chips. In FIG. 1, first shaft 14 is shown with a plurality of cutting wheels 30, and second shaft 16 is shown with a plurality of identical but opposed cutting wheels 32. In FIG. 1, the shafts and cutting wheels are shown spaced apart for ease of explanation. However, the actual position of the shafts and spacing of the wheels results in the first plurality of cutting wheels 30 being interleaved with the second plurality of cutting wheels 32 as shown in FIG. 2. FIG. 2 depicts all of the cutting wheels 30 and 32 as having cutting teeth 34 similar in configuration to the cutting teeth disclosed in U.S. Pat. No. 5,560,552. However, the present invention is not limited to any particular configuration of cutting wheels or cutting teeth. Furthermore, the shafts and cutting wheels can be configured with spacers between cutting wheels and material strippers for stripping compacted material from the spacers. These components are conventional, and will not be described further.

In accordance with the invention, a divider is mounted in the chamber perpendicular to the first and second shafts and intermediate the first and second distal ends, the divider having first and second arcuate openings through which the first and second shafts project, the divider dividing the chamber into first and second chamber portions. As shown in FIG. 1, a solid divider wall 36 is mounted in chamber 12, oriented perpendicular to the direction of orientation shafts 14 and 16, and positioned intermediate the distal ends 18, 20, and 22, 24. The divider wall 36 thereby partitions chamber 12 into multiple chambers. In addition, divider wall 36 adds structural integrity to the chamber 12. As shown in FIG. 1, chamber 12 is divided into a first chamber portion 12*a* and a second chamber portion 12*b*. However, although a dual chambered configuration is shown and preferred, the invention is not limited to two chambers. With a suitable diverter device (described below) it would be within the scope of the invention to provide additional divider walls 36, further dividing chamber 12 into additional chamber portions.

Figure 3:
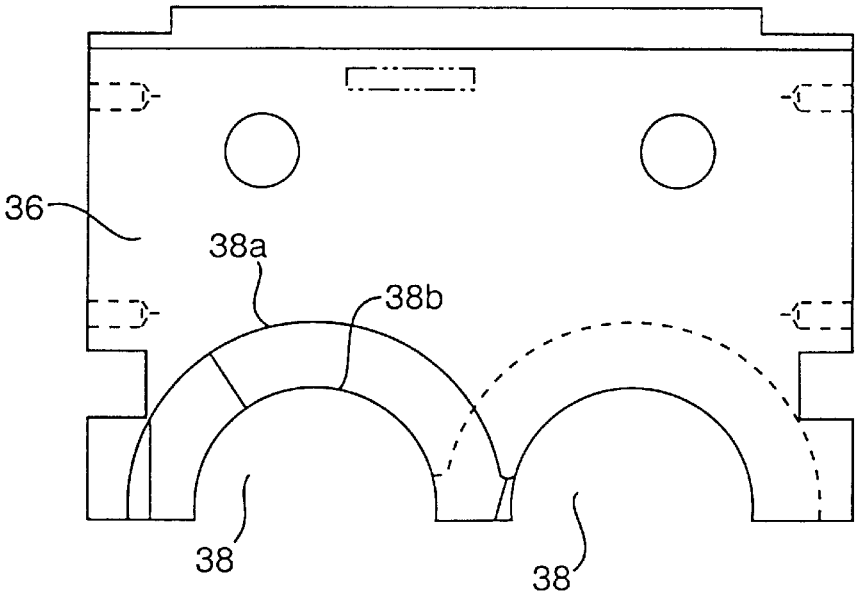
FIG. 3 is a front view of a divider used to separate a compaction device into a multiple-chambered compaction device in accordance with the invention.
Figure 4:
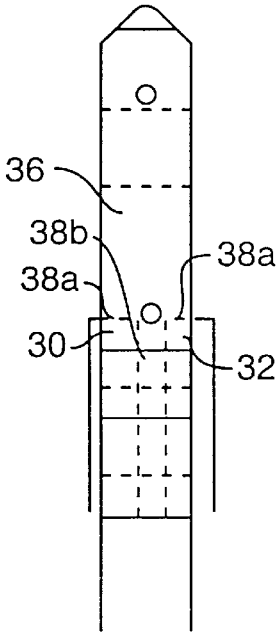
FIG. 4 is a side view of the divider shown in FIG. 3.

Preferably, divider wall 36 includes arcuate openings through which the shafts 14 and 16 project. As shown in FIG. 3, a pair of arcuate openings 38 are provided in divider wall 36. The arcuate openings 38 have a first portion 38*a* or "eyebrow," with a radius that is just slightly larger than the radius of the cutting wheels 30 and 32, and a second portion 38*b* with a radius less than the radius of the cutting wheels 30 and 32. The lateral distance between first portion 38*a* and second portion 38*b* equals approximately one half the thickness of an individual cutting wheel 30 or 32. Therefore, the cutting wheels 30 and 32 can pass partially underneath arcuate openings 38, as shown for example in FIG. 4. In this manner, the arcuate openings 38 can provide passage therethrough for shafts 14 and 16, but are effectively sealed by the cutting wheels 30, 32, preventing cullet in one chamber 12*a* from passing through the arcuate openings 38 and entering the other chamber 12*b*.

In accordance with the invention, a diverter is provided for diverting containers into one or the other of said first and second chamber portions. As shown in FIG. 1, a diverter 40 is provided. In FIG. 1, diverter 40 is shown separated from chamber 12 for ease of explanation. In the actual embodiment, diverter 40 is positioned directly above chamber 12.

Preferably, diverter 40 includes a housing 42, in which is mounted a first flap 44, a second flap 46, and a third flap 48. A motor 50 is provided on a side of housing 42, which is connected via a rocker arm assembly 52 to first flap 44. The rocker arm assembly 52 further communicates to second and third flaps 46 and 48 via a pivotable assembly 54, which can be a T-bar linkage or sprockets with a chain linkage.

Motor 50 receives input from a sensor assembly 56. Sensor assembly 56, which is mounted remote from motor 50, senses characteristics of incoming containers. For example, sensor assembly 56 may sense the material of the container, e.g., aluminum or plastic, and the type of plastic, e.g., PET or PVC. Moreover, sensor assembly 56 may sense the color of the container, e.g., clear, opaque, green, brown, and so on. Such sensor assemblies are well known in the art and are described for example in U.S. Pat. Nos. 5,355,987; 5,028,870; and 4,919,534, all owned by applicants' assignee, the disclosures of which are specifically incorporated herein by reference. Accordingly, sensor assembly 56 will not be further described.

In response to a signal received from sensor assembly 56, motor 50, acting through rocker arm assembly 52, pivots first flap 44 between a first position and a second position. In the first position, first flap 44 cooperates with second flap 46 to close off access to the second chamber portion 12*b*, and allow access to the first chamber portion 12*a*. In the second position, first flap 44 cooperates with third flap 48 to close off access to first chamber portion 12*a*, and allow access to the second chamber portion 12*b*.

Figure 5A:
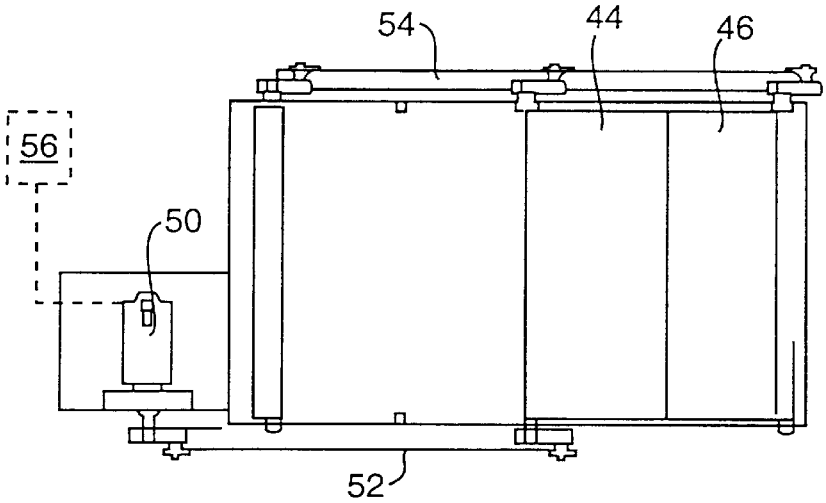
FIG. 5A is a top view of the diverter in accordance with the invention in a first position.
Figure 5B:
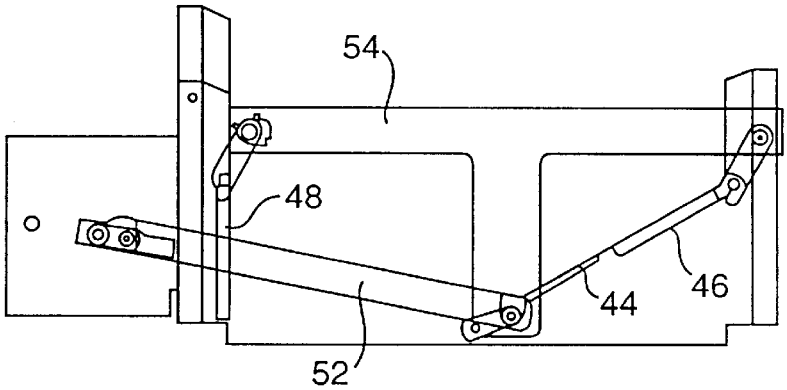
FIG. 5B is a side view of the diverter in the first position shown in FIG. 5A.

The diverter flap positions are shown in FIGS. 5A–5E. Referring to FIGS. 5A and 5B, first flap 44 and second flap 46 align with one another in the first position to define a plane. Preferably, as shown in FIG. 5B, there is no overlap between flaps 44 and 46. Furthermore, third flap 48 hangs straight down, out of the way. In this position, access to second chamber portion 12*b* is denied. Therefore, any container entering diverter 40 will drop to the left (as oriented in FIGS. 5A and 5B), and enter first chamber portion 12*a*.

Figure 5C:
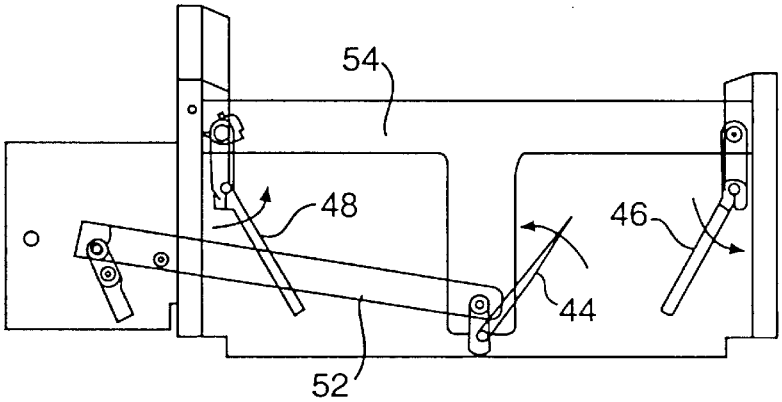
FIG. 5C is a side view of the diverter in accordance with the invention shifting from a first position to a second position.
Figure 5D:
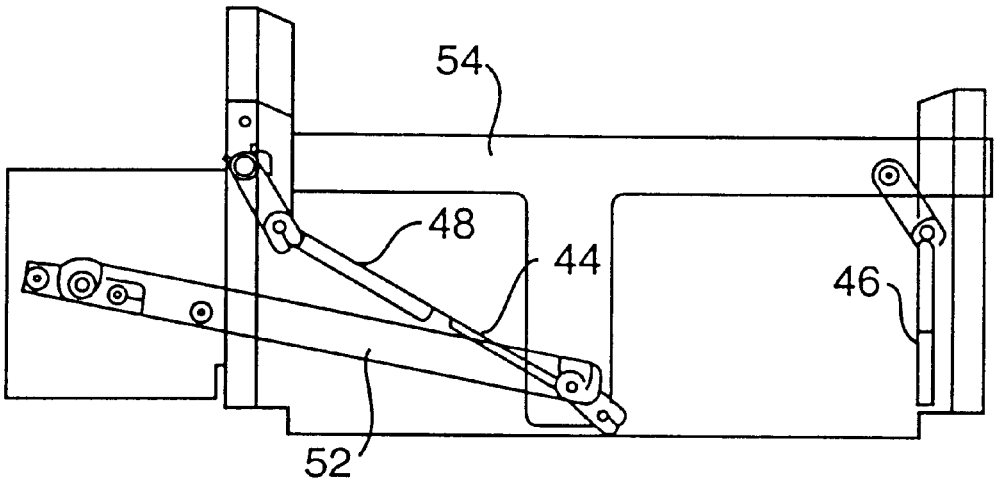
FIG. 5D is a side view of the diverter in accordance with the invention in a second position.
Figure 5E:
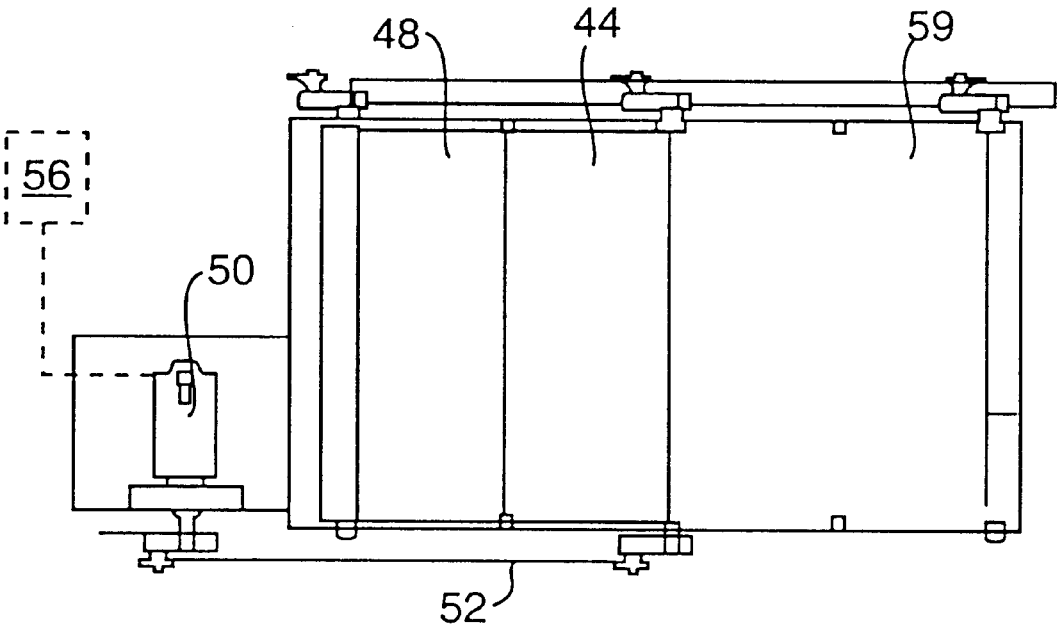
FIG. 5E is a top view of the diverter in the second position shown in FIG. 5D.

FIG. 5C shows the flaps shifting to the second position. Motor 50 is acting via rocker arm assembly 52 and pivotal T-bar assembly 54 to pivot first flap 44 to the left, second flap 46 to the right out of the way, and third flap 48 to the right in order to align with first flap 44. The second position is achieved in FIGS. 5D and 5E. In these drawings, flaps 44 and 48 are aligned to define a plane with no overlap between flaps, and second flap 46 hangs out of the way. The flaps do not overlap in order to avoid a condition where beverage syrup causes overlapping flaps to stick together. Therefore, the flaps are dimensioned appropriately to define an uninterrupted plane with no overlap. In this position, access to first chamber portion 12*a* is denied. Therefore, any container entering diverter 40 will be routed to the right and enter second chamber portion 12*b*.

The diverter and multiple chambers of the compaction device enable segregated compaction of containers. For example, when the sensor assembly senses an aluminum container, first flap 44 and second flap 46 may pivot to the first position, diverting the aluminum container to first chamber portion 12*a*, to be compacted by interleaved compacting wheels 30 and 32 in first chamber portion 12*a*. On the other hand, if sensor assembly 56 senses a plastic container, first flap 44 and third flap 48 may pivot to the second position, diverting the plastic container to second chamber portion 12*b* to be compacted. In this way, aluminum and plastic containers can always be compacted in segregated chambers of a single compaction assembly. The same type of separation could be performed for, e.g., PET and PVC containers, or for clear plastic and green plastic containers.

Only one type of container is sent to any particular chamber portion, thereby preventing cross-contamination because aluminum cullet will never collect on the compacting wheels of a chamber portion used for PVC or PET. The diverter flaps sealing off one chamber portion also prevent the compacted cullet from one chamber portion from flying up and entering the other chamber portion. Cross-contamination between chamber portions is further prevented by the configuration of divider wall 36, including the arcuate openings 38, as described above.

In order to further maintain segregation of the cullet after compaction, a separating wall and separate storage bins are provided. As shown in FIG. 1, a divider wall 61 extends below chamber 12, parallel to and beneath shafts 14 and 16. Wall 61 enables first chamber portion 12*a* to empty into a first storage bin 62 on one side of wall 61, and second chamber portion 12*b* to empty into a second storage bin 64 on the other side of wall 61. In the embodiment of FIG. 1, the storage bins are oriented rotated 90° with respect to first and second chamber portions 12*a* and 12*b*, so ramps 66 and 68 are provided beneath the cutting wheels to drop cullet into the appropriate storage bin. However, it is also possible to provide storage bins 62 and 64 directly beneath the respective chamber portions 12*a* and 12*b*, thereby eliminating the need for ramps 66 and 68. The storage bins 62 and 64 can be removable.

Figure 6:
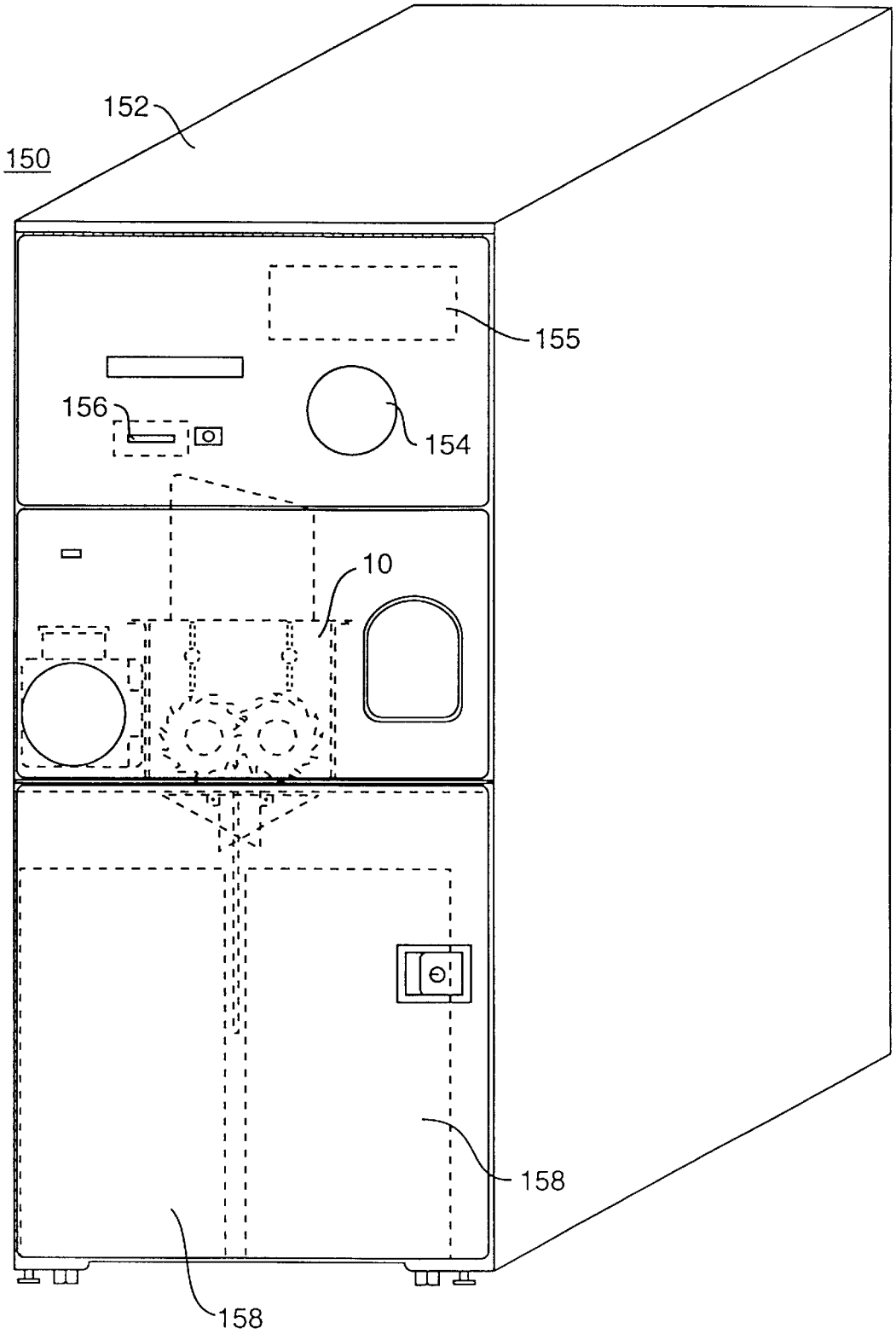
FIG. 6 is a perspective view of a cabinet of a reverse vending machine in which the compaction device of the present invention can be used.

In accordance with the invention, a container compaction assembly can be installed in a reverse vending machine. As broadly embodied herein, and referring to FIG. 6 a reverse vending machine 150 includes a cabinet 152. An acceptance mechanism 154, which may be for example a door or chute or feed mechanism, is provided in the cabinet for accepting a container. A sensor 155 senses a characteristic of the container, e.g., material of composition, color and the like. Container compaction assembly 10 of the present invention is mounted within the cabinet 152, to receive and densify plastic and aluminum containers which participate in the recycling program. It is understood that additional densification devices, including glass crushers and container flatteners, may also be provided in cabinet 152, but are not shown in FIG. 6. A refund device 156 is provided to issue a refund to the consumer in exchange for the container. Refunds may include cash, vouchers, coupons, or some combination of the above. Finally storage bins 158 are provided to store the chips of compacted material. Although storage bins 158 are depicted in FIG. 6 inside the cabinet 152, it is understood that storage bins 158 may be provided external to the cabinet 152, with some means to pneumatically transfer the chips to the external storage bins 158. Various configurations of reverse vending machines are well known, and therefore will not be discussed here in further detail. The container compaction assembly of the present invention is suitable for use with a number of reverse vending machines, and can be modified as necessary for a particular configuration.

It will be apparent to those skilled in the art that various modifications and variations can be made in the embodiment of the present invention described above without departing from the spirit or scope of the invention. Thus, it is intended that the present invention covers the modifications and variations of this invention provided they come within the scope of the appended claims and their equivalents.

What is claimed is:

1. A container compaction assembly comprising:

a single chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said single chamber perpendicular to said first and second shafts and intermediate said first and second distal ends, said divider having first and second arcuate openings through which said first and second shafts project, said divider dividing said single chamber into first and second chamber portions; and a diverter for diverting containers into one or the other of said first and second chamber portions;

wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said first and second flaps, and said first and third flaps each cooperate to define a plane, respectively, of flaps in an aligned but non-overlapping relationship.

2. A container compaction assembly comprising:

a chamber;

first and second parallel counter-rotatable shafts rotatably mounted in the chamber, each shaft defining an axis and having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions;

a diverter for diverting containers into one or the other of said first and second chamber portions;

wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said first and second flaps, and said first and third flaps each cooperate to define a plane, respectively, of flaps in an aligned but non-overlapping relationship; and a storage area having a wall positioned below the chamber, the wall being disposed generally parallel to the axes defined by the shafts and generally perpendicular to the divider defining a plurality of storage chambers within the storage area.

3. The assembly of claim 1 or 2, further comprising a first storage bin positioned to receive material from said first chamber portion, and a second storage bin positioned to receive material from said second chamber portion.

4. The assembly of claim 1 or 2, wherein said compacting wheels have a first radius and said arcuate openings in said divider have a portion having a second radius greater than said first radius.

5. The assembly of claim 4, wherein a portion of at least one of said compacting wheels is positioned beneath the first arcuate opening.

6. The container compaction assembly of claim 2, further comprising a first ramp for connecting the first chamber portion to one of the storage chambers of the storage area.

7. The container compaction assembly of claim 6, further comprising a second ramp for connecting the second chamber portion to another one of the storage chambers of the storage area.

8. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a single chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said single chamber perpendicular to said first and second shafts and intermediate said first and second distal ends, said divider having first and second arcuate openings through which said first and second shafts project, said divider dividing said single chamber into first and second chamber portions; and a diverter for diverting containers into one or the other of said first and second chamber portions in accordance with the sensed characteristic wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said first and second flaps, and said first and third flaps, each cooperate to define a plane, respectively, of flaps in an aligned but non-overlapping relationship.

9. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a chamber;

first and second parallel counter-rotatable shafts rotatably mounted in the chamber, each shaft defining an axis and having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions;

a diverter for diverting containers into one or the other of said first and second chamber portions in accordance with the sensed characteristic wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said first and second flaps, and said first and third flaps, each cooperate to define a plane, respectively, of flaps in an aligned but non-overlapping relationship; and a storage area having a wall positioned below the chamber, the wall being disposed generally parallel to the axes defined by the shafts and generally perpendicular to the divider defining a plurality of storage chambers within the storage area; and (e) a device in the cabinet for issuing a refund in exchange for the container.

10. The reverse vending machine of claim 8 or 9 further comprising a first storage bin positioned to receive material from said first chamber portion, and a second storage bin positioned to receive material from said second chamber portion.

11. The reverse vending machine of claims 8 or 9, wherein said compacting wheels have a first radius and said arcuate openings in said divider have a portion having a second radius greater than said first radius.

12. The reverse vending machine of claim 11, wherein a portion of at least one of said compacting wheels is positioned beneath the first arcuate opening.

13. The reverse vending machine of claim 9, further comprising a first ramp for connecting the first chamber portion to one of the storage chambers of the storage area.

14. The reverse vending machine of claim 13, further comprising a second ramp for connecting the second chamber portion to another one of the storage chambers of the storage area.

15. A container compaction assembly comprising:

a chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft, said plurality of compacting wheels having a first radius;

a divider mounted in said chamber perpendicular to said first and second shafts and intermediate said first and second distal ends, said divider having first and second arcuate openings through which said first and second shafts project, said divider dividing said chamber into first and second chamber portions, said arcuate openings in said divider having a portion having a second radius greater than said first radius; and a diverter for diverting containers into one or the other of said first and second chamber portions.

16. The assembly of claim 15, wherein a portion of at least one of said compacting wheels is positioned beneath the first arcuate opening.

17. A container compaction assembly comprising:

a chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions; and a diverter for diverting containers into one or the other of said first and second chamber portions, said diverter including a first flap pivotable between a first position, closing off access to said second chamber portion and allowing access to said first chamber portion, and a second position closing off access to said first chamber portion and allowing access to said second chamber portion, said diverter further including second and third flaps, said second flap cooperating with said first flap in said first position to close off access to said second chamber portion, and said third flap cooperating with said first flap in said second position to close off access to said first chamber portion, said first and second flaps, and said first and third flaps, each cooperating to define a plane, respectively, of flaps in an aligned but non-overlapping relationship.

18. A container compaction assembly comprising:

a chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions; and a diverter for diverting containers into one or the other of said first and second chamber portions, said diverter including a first flap pivotable between a first position, closing off access to said second chamber portion and allowing access to said first chamber portion, and a second position closing off access to said first chamber portion and allowing access to said second chamber portion, said diverter further including second and third flaps, said second flap cooperating with said first flap in said first position to close off access to said second chamber portion, and said third flap cooperating with said first flap in said second position to close off access to said first chamber portion, said diverter further including a motor, rocker arm, and T-bar assembly for pivoting said first flap, second flap, and third flap between said first position and second position in response to a characteristic of the containers sensed by a sensing device.

19. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft, said compacting wheels having a first radius;

a divider mounted in said chamber perpendicular to said first and second shafts and intermediate said first and second distal ends, said divider having first and second arcuate openings through which said first and second shafts project, said divider dividing said chamber into first and second chamber portions, said arcuate openings in said divider having a portion having a second radius greater than said first radius; and a diverter for diverting containers into one or the other of said first and second chamber portions in accordance with the sensed characteristic; and (e) a device in the cabinet for issuing a refund in exchange for the container.

20. The reverse vending machine of claim 19, wherein a portion of at least one of said compacting wheels is positioned beneath the first arcuate opening.

21. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions; and a diverter for diverting containers into one or the other of said first and second chamber portions in accordance with the sensed characteristic, said diverter including a first flap pivotable between a first position, closing off access to said second chamber portion and allowing access to said first chamber portion, and a second position closing off access to said first chamber portion and allowing access to said second chamber portion, said diverter further including second and third flaps, said second flap cooperating with said first flap in said first position to close off access to said second chamber portion, and said third flap cooperating with said first flap in said second position to close off access to said first chamber portion, said first and second flaps, and said first and third flaps, each cooperate to define a plane, respectively, of flaps in an aligned but non-overlapping relationship; and (e) a device in the cabinet for issuing a refund in exchange for the container.

22. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions; and a diverter for diverting containers into one or the other of said first and second chamber portions in accordance with the sensed characteristic, said diverter including a first flap pivotable between a first position, closing off access to said second chamber portion and allowing access to said first chamber portion, and a second position closing off access to said first chamber portion and allowing access to said second chamber portion, said diverter further including second and third flaps, said second flap cooperating with said first flap in said first position to close off access to said second chamber portion, and said third flap cooperating with said first flap in said second position to close off access to said first chamber portion, said diverter further including a motor, rocker arm, and T-bar assembly for pivoting said first flap, second flap, and third flap between said first position and said second position in response to the characteristic of the container sensed by the sensing device; and (e) a device in the cabinet for issuing a refund in exchange for the container.

23. A container compaction assembly comprising:

a single chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said single chamber perpendicular to said first and second shafts and intermediate said first and second distal ends, said divider having first and second arcuate openings through which said first and second shafts project, said divider dividing said single chamber into first and second chamber portions; and a diverter for diverting containers into one or the other of said first and second chamber portions;

wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said diverter further includes a motor, rocker arm, and T-bar assembly for pivoting said first flap, second flap, and third flap between said first position and second position in response to a sensed characteristic of the container.

24. A container compaction assembly comprising:

a chamber;

first and second parallel counter-rotatable shafts rotatably mounted in the chamber, each shaft defining an axis and having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions;

a diverter for diverting containers into one or the other of said first and second chamber portions;

wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said diverter further includes a motor, rocker arm, and T-bar assembly for pivoting said first flap, second flap, and third flap between said first position and second position in response to a sensed characteristic of the container; and a storage area having a wall positioned below the chamber, the wall being disposed generally parallel to the axes defined by the shafts and generally perpendicular to the divider defining a plurality of storage chambers within the storage area.

25. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a single chamber;

first and second parallel counter-rotatable shafts rotatably mounted in the chamber, each shaft having first and second distal ends;

a first and second plurality of compacting wheels positioned on the first and second shafts, respectively, said first plurality of compacting wheels on said first shaft being interleaved with said second plurality of compacting wheels on said second shaft;

a divider mounted in said single chamber perpendicular to said first and second shafts and intermediate said first and second distal ends, said divider having first and second arcuate openings through which said first and second shafts project, said divider dividing said single chamber into first and second chamber portions; and a diverter for diverting containers into one or the other of said first and second chamber portions in accordance with the sensed characteristic, wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said diverter further includes a motor, rocker arm, and T-bar assembly for pivoting said first flap, second flap, and third flap between said first position and second position in response to a characteristic of the container sensed by the sensing device.

26. A reverse vending machine comprising:

(a) a cabinet;

(b) an acceptance mechanism in the cabinet for receiving a container;

(c) a sensor for sensing a characteristic of the container;

(d) a container cutting assembly in the cabinet comprising:

a chamber;

first and second parallel counter-rotatable shafts rotatably mounted in the chamber, each shaft defining an axis and having first and second distal ends;

a first and second plurality of compacting wheels positioned on the first and second shafts, respectively, said first plurality of compacting wheels on said first shaft being interleaved with said second plurality of capacity wheels on said second shaft;

a divider mounted in said chamber perpendicular to said first and second shafts and intermediate said first and second distal ends, said divider having first and second arcuate openings through which said first and second shafts project, said divider dividing said chamber into first and second chamber portions;

a diverter for diverting containers into one or the other of said first and second chamber portions in accordance with the sensed characteristic wherein said diverter includes a first flap pivotable between a first position, closing off access to said second chamber portion and allowing access to said first chamber portion, and a second position closing off access to said first chamber portion and allowing access to said second chamber portion, a second flap cooperating with said first flap in said first position to close off access to said second chamber portion, and a third flap cooperating with said first flap in said second position to close off access to said first chamber portion, and wherein said diverter further includes a motor, rocker arm, and T-bar assembly for pivoting said first flap, second flap, and third flap between said first position and second position in response to a characteristic of the container sensed by the sensing device.

* * * * *